US010717624B2

(12) United States Patent
Dehner et al.

(10) Patent No.: US 10,717,624 B2
(45) Date of Patent: Jul. 21, 2020

(54) CUTTING DEVICE FOR CONTINUOUS LABELS

(71) Applicant: Bizerba SE & Co. KG, Balingen (DE)

(72) Inventors: Moritz Dehner, Hechinger (DE); Alexander Hirsch, Kirchheim unter Teck (DE)

(73) Assignee: BIZERBA SE & CO. KG, Balingen (DE)

( * ) Notice: Subject to any disclaimer, the term of this patent is extended or adjusted under 35 U.S.C. 154(b) by 0 days.

(21) Appl. No.: 16/211,264

(22) Filed: Dec. 6, 2018

(65) Prior Publication Data

US 2019/0202654 A1 Jul. 4, 2019

(30) Foreign Application Priority Data

Dec. 31, 2017 (EP) ..... 17211267

(51) Int. Cl.

| | |
|---|---|
| ***B41J 11/70*** | (2006.01) |
| ***B65H 35/08*** | (2006.01) |
| ***B26D 5/08*** | (2006.01) |
| ***B26D 1/08*** | (2006.01) |
| ***B41J 3/407*** | (2006.01) |
| ***B65H 16/00*** | (2006.01) |
| *B26D 1/00* | (2006.01) |
| *B41J 11/66* | (2006.01) |

(52) U.S. Cl.

CPC ..... *B65H 35/08* (2013.01); *B26D 1/085* (2013.01); *B26D 5/08* (2013.01); *B41J 3/4075* (2013.01); *B41J 11/703* (2013.01); *B65H 16/005* (2013.01); *B26D 2001/0066* (2013.01); *B41J 11/666* (2013.01)

(58) Field of Classification Search

CPC ..... B65H 35/08; B65H 16/005; B26D 1/085; B26D 5/08; B26D 2001/0066; B41J 3/4075; B41J 11/703; B41J 11/666

See application file for complete search history.

(56) References Cited

U.S. PATENT DOCUMENTS 4,312,597 A * 1/1982 Shimizu ..... B41J 11/663 101/224

6,109,154 A 8/2000 Miyatsu et al.

(Continued)

FOREIGN PATENT DOCUMENTS

EP 2842757 B1 4/2017

*Primary Examiner* — Yaovi M Ameh

(74) *Attorney, Agent, or Firm* — Leydig, Voit & Mayer Ltd.

(57) ABSTRACT

A printer for printing on a print medium includes: a receptacle for taking up the print medium into a roll; a print head for printing onto the print medium during a printing process; a print roller for directing the print medium past the print head during the printing process; and a cutting device for separating a printed portion of the print medium. The cutting device includes a stationary blade, a blade that is movable against the stationary blade, and a drive motor for moving the movable blade from a rest position, into a cutting position, and back. The drive motor includes a transmission and at least one drive pin. A rotational movement of the drive motor with the transmission and the at least one drive pin is converted into a linear movement of the moving blade. A movement path of the at least one drive pin is circular or elliptical.

13 Claims, 6 Drawing Sheets

(56) References Cited

U.S. PATENT DOCUMENTS

| | | | | |
|---|---|---|---|---|
| 6,508,600 | B1 * | 1/2003 | Nonaka | B26D 1/085 101/227 |
| 2003/0076396 | A1 * | 4/2003 | Imai | B41J 11/70 347/101 |
| 2005/0183560 | A1 * | 8/2005 | Nonaka | B26D 1/0006 83/614 |
| 2010/0086340 | A1 * | 4/2010 | Takami | B26D 7/088 400/621 |
| 2014/0030001 | A1 * | 1/2014 | Hanaoka | B41J 11/663 400/621 |
| 2015/0251457 | A1 * | 9/2015 | Lee | B41J 11/70 83/563 |

* cited by examiner

CUTTING DEVICE FOR CONTINUOUS LABELS

CROSS-REFERENCE TO PRIOR APPLICATION

Priority is claimed to European Patent Application No. EP 17 211 267.4, filed on Dec. 31, 2017, the entire disclosure of which is hereby incorporated by reference herein.

FIELD

The present invention relates to a printer for printing on a print medium, and to a cutting device for separating a printed portion of the print medium.

BACKGROUND

EP 2 842 757 B1 shows a printer and a cutting device for separating a printed print medium, with a movable blade which is replaceable. The replacement requires disassembly of the cutting device and removal of a sliding blade element.

SUMMARY

In an embodiment, the present invention provides a printer for printing on a print medium, comprising: a receptacle configured to take up the print medium into a roll; a print head configured to print onto the print medium during a printing process; a print roller configured to direct the print medium past the print head during the printing process; and a cutting device configured to separate a printed portion of the print medium, the cutting device comprising a stationary blade, a blade that is movable against the stationary blade, and a drive motor configured to move the movable blade from a rest position, into a cutting position, and back, the drive motor comprising a transmission and at least one drive pin, wherein a rotational movement of the drive motor with the transmission and the at least one drive pin is converted into a linear movement of the moving blade, wherein a movement path of the at least one drive pin is circular or elliptical, and wherein the movable blade comprises a connecting link guide into which the at least one drive pin engages.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
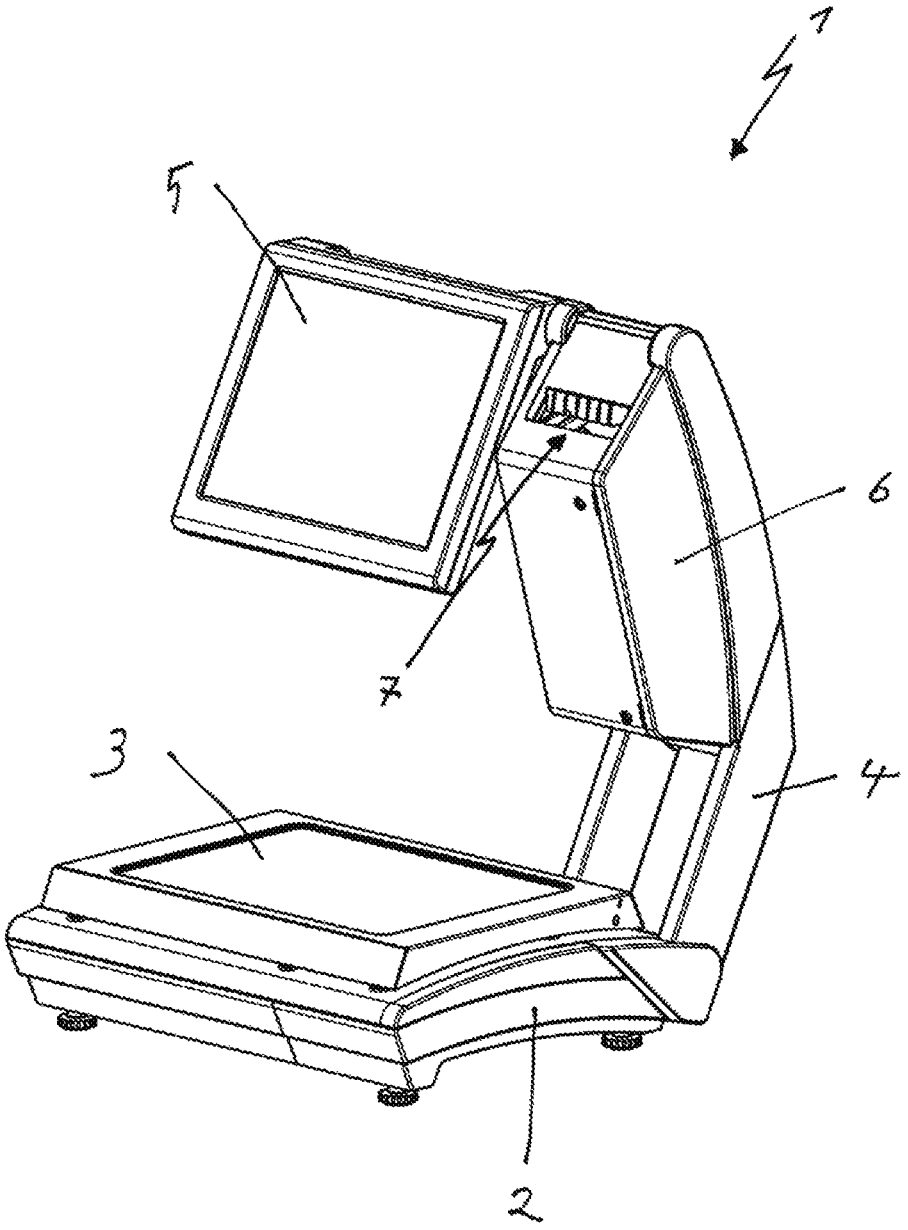
FIG. 1 a scale with printer.

The aim of the invention is to provide a printer with a cutting device for separating a printed portion of the print medium, in which the replacement of a blade of the cutting device may be carried out simply and without tools, even by untrained personnel.

According to the invention, a printer for printing on a print medium is proposed. The printer comprises a receptacle for the print medium. The print medium is taken up into a roll. The printer comprises a print head for printing on the print medium during a printing operation. The printer comprises a print roller for directing the print medium past the print head during the printing process. The printer furthermore comprises a cutting device for separating a printed portion of the print medium. The cutting device comprises a stationary blade and a blade movable against the stationary blade. The cutting device comprises a drive motor with the aid of which the movable blade can be moved from a rest position, into a cutting position, and back. A rotational movement of the drive motor is converted, with a transmission and at least one drive pin, into a linear—preferably non-uniform—movement of the movable blade. The movement path of the at least one drive pin is circular or elliptical. However, the drive pin does not follow a complete orbit, but rather the path of a circle segment—for example, of a semicircle. The movable blade includes a connecting link guide in which the drive pin engages. In one embodiment, the movable blade is removable in the cutting position by pulling it out of the cutting device. In one embodiment, the movable blade can be moved by means of the drive motor into a removal position, from which the movable blade can be removed by pulling it out. In one embodiment, the movement of the print roller is synchronized with the movement of the drive motor of the cutting device, and thus with the movement of the movable blade, so that the print medium is separated at the correct point in time.

In one embodiment, in a first segment, the connecting link guide extends from one edge of the movable blade, which edge is situated opposite a cutting edge of said movable blade, in a direction parallel to the movement direction of the movable blade. That means that the first segment of the connecting link guide moves from the edge of the movable blade in the direction of its center. The connecting link guide extends into an opening at the edge of the movable blade.

In one embodiment, the connecting link guide has a second segment whose direction of extension differs from the movement direction of the movable blade. In one embodiment, the extension direction of the second segment of the connecting link guide is perpendicular to the movement direction of the movable blade. In one embodiment, the second segment of the connecting link guide is a linear segment.

In one embodiment, the transmission drives a second drive pin. The second drive pin engages in a second connecting link guide. In one embodiment, the two drive pins are of the same size and, during their movement, are located at the same height with respect to the movement direction of the movable blade.

In one embodiment, the movement paths of the two drive pins run mirror-symmetrically along an axis that is parallel to the movement direction of the movable blade. In one embodiment, the two connecting link guides are arranged mirror-symmetrically relative to this axis in the movable blade.

In one embodiment, the printer comprises a printer housing and a printer door. The printer door can execute a rotational movement for opening said printer door. The movable blade is arranged in the printer housing, and the fixed blade is arranged in the printer door. In one embodiment, the movable blade is arranged in the printer door, and the fixed blade is arranged in the printer housing.

In one embodiment, the movable blade is executed as one piece. In one embodiment, the movable blade slides in a guide of the cutting device, wherein the movement direction of the movable blade is limited by the guide to one direction—the movement direction. What is to be understood by this is that the blade can be moved both forwards and backwards in the movement direction.

In one embodiment, a cutting edge of the movable blade is formed in a V-shape. At the inflection point of the V-shape, which preferably is arranged in the middle of the movable blade, said movable blade has a recess.

In one embodiment, the transmission is designed such that the at least one drive pin may be brought into a removal position by means of a rotational movement of the drive motor. In the removal position, the at least one drive pin engages in the first segment of the connecting link guide. In one embodiment, the removal position is identical to the cutting position. However, the blade remains in the removal position, meaning that the at least one drive pin is moved by the drive motor in such a way that the movable blade remains in the removal position. During the normal cutting process, the at least one drive pin is moved by the drive motor in such a way that the movable blade is brought into the cutting position and is moved back again into the rest position immediately after the cutting process. Even if the removal position and the cutting position are identical with regard to the geometric position of the at least one drive pin, the removal position differs in that the movable blade is not led back again immediately. Moreover, the movable blade may be brought into the removal position if the printer door is opened. By contrast, a cutting process is not possible if the printer door is opened.

In one embodiment, the printer comprises a sensor for monitoring the printer door. The movement of the at least one drive pin into the removal position by the drive motor is possible only if the printer door is opened. Only then may an operator grasp the movable blade and remove it from the cutting device, in order, for example, to change the movable blade when this is worn out.

In one embodiment, the movable blade is directed between a cover plate and a guide plate. The guide plate and the cover plate determine the lateral position of the movable blade in the cutting device and in the printer. The cover plate forms an outer wall of the cutting device, and the guide plate forms a wall inside the cutting device. In one embodiment, the guide plate comprises two semi-circular recesses in which the drive pins are moved, and, via these, the drive pins engage in the connecting link guide of the movable blade. In one embodiment, the movement direction of the movable blade is defined by a lateral guide. In one embodiment, the lateral guide consists of guide pins which run between cover plate and guide plate and predetermine the movement direction of the movable blade.

In one embodiment, the transmission comprises two identical drive gears. "Identical" means that the drive gears have the same diameter and the same number of teeth, and that the drive pins are located at the same distance from the midpoint. The drive gears each retain a drive pin and are arranged symmetrically relative to the movement direction of the movable blade. The transmission comprises two identical translation gears that mutually engage with one another. Each translation gear engages in a drive gear. The drive motor drives a translation gear by means of a motor gear. Via this arrangement, the drive pins on the drive gears move symmetrically with respect to an axis parallel to the movement direction of the movable blade. This means that the drive gears move in opposite directions.

According to the invention, a method is proposed for exchanging a movable blade of a cutting device of a printer. The method includes the step of receiving a blade exchange instruction at an input device of the printer, and transitioning the printer into a service mode. The method includes the step of rotating a drive motor of a cutting device into a position in which the drive pins are in a removal position. The method includes the step of receiving an instruction that the cutting device is to transition into a printing mode again. In one embodiment, this instruction is received via the input device, if, for example, an operator has completed the blade exchange and inputs this at the input device. In one embodiment, this instruction is received by a sensor that detects a completed blade exchange. The method includes the step of rotating the drive motor into a position in which the drive pins are in the rest position. The exchanged movable blade is thus retracted into the cutting device. The method includes the step of transitioning the printer into the printing mode.

In one embodiment, prior to rotation of the drive motor into a position in which the drive pins are in the removal position, the method includes the step of checking by means of a sensor whether the printer door has been opened.

In one embodiment, prior to transitioning the printer into the printing mode, the method includes the step of checking by means of a sensor whether the printer door has been closed.

FIG. 1 schematically shows a scale 1 with printer 6. The scale 1 comprises a housing 2 and a load plate 3 for placement of goods to be weighed. Mounted in the housing 2 is a weighing device which determines the weight of the goods placed upon the load plate 3. The scale 1 comprises a stand 4 to which the printer 6 is fastened, and to which, furthermore, an input device 5 for operating the scale 1 is attached. Instructions for the printer 6 may also be input via the input device 5. The printer 6 comprises an output opening 7, behind which is located a cutting device for separating a printed portion of a print medium.

Figure 2:
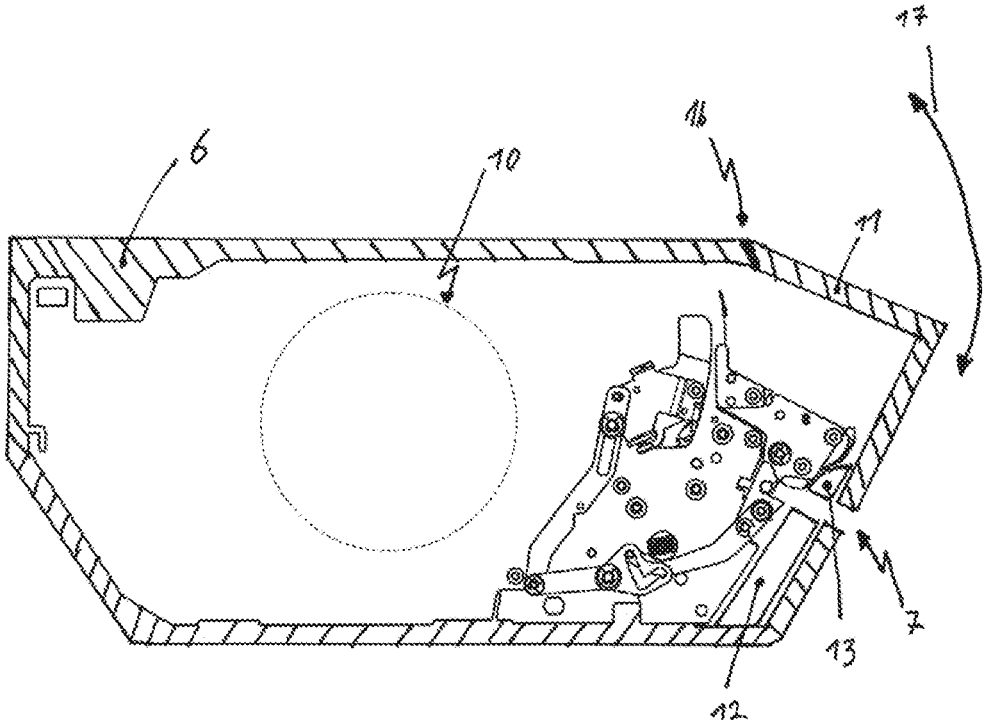
FIG. 2 a printer for a scale, with closed printer door.
Figure 3:
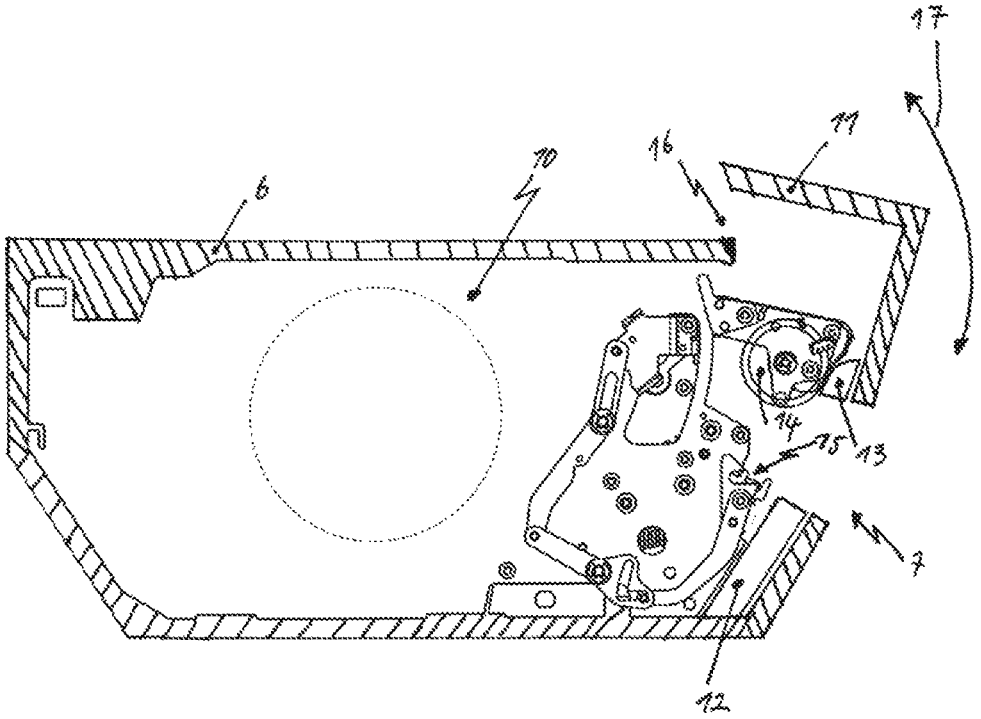
FIG. 3 a printer for a scale, with opened printer door.

FIG. 2 shows a section through a printer 6 according to the invention, in which the printer door 11 is closed. The printer may be installed in a scale according to FIG. 1. Alternatively, the printer 6 may also be installed in the housing of a scale, below the load plate. FIG. 3 shows the printer 6 when the printer door 11 is open, and the printer 6 is in service mode. The printer 6 comprises a receptacle 10 for a print medium taken up to form a roll. The printer door 11 is borne on a hinge or a guide, and may be opened and closed by the operator along a movement direction 17. The printer 6 comprises a print roller 14 for directing the print medium past a print head 15 during a printing process, which print head 15 prints on the print medium. The printer 6 comprises a cutting device 12, 13 for separating the print medium. The cutting device comprises a housing 12, in which is borne a movable blade, and a fixed blade 13. The fixed blade 13 is mounted in the printer door 11. The housing 12 of the cutting device is mounted in the housing of the printer 6. Located between the housing of the printer 6 and the printer door 11 is an output opening 7, through which the printed portion of the print medium is output. The printer 6 further comprises a sensor 16 which detects whether the printer door 11 is closed or open.

Figure 4:
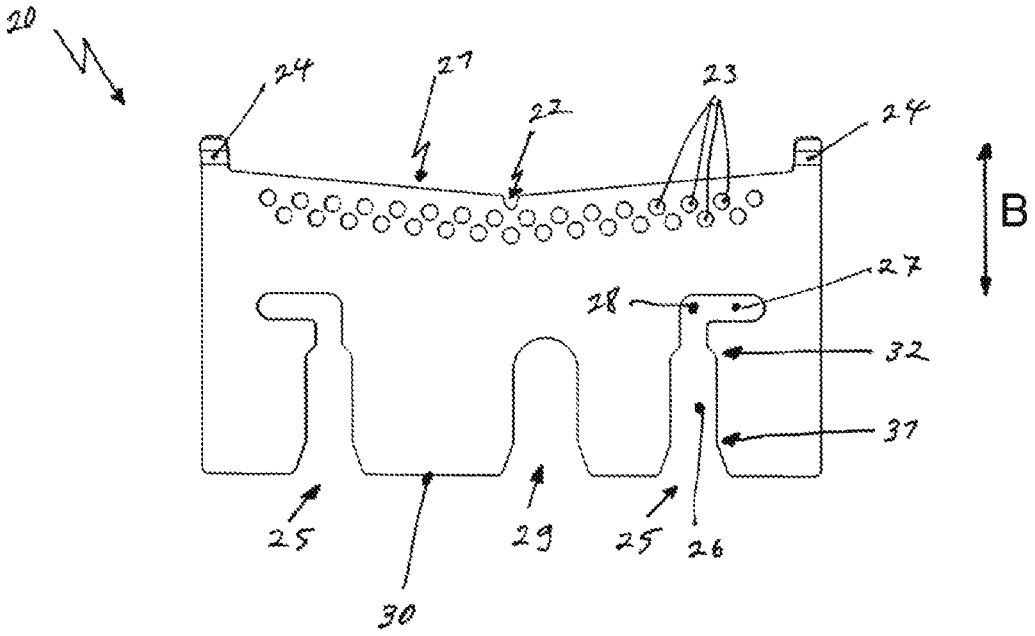
FIG. 4 a movable blade for a cutting device according to the invention.

FIG. 4 shows a movable blade 20 for a cutting device according to the invention. The movable blade 20 may be removed from the cutting device without tools. The movable blade 20 has a cutting edge 21. The cutting edge 21 has a V-shape. At the inflection point of the V-shape, in the middle of the cutting edge 21, the movable blade 20 has a recess 22. With this recess, a partial cut may also take place, meaning that the print medium is not entirely severed in the middle and is still attached to a piece by the width of the recess. The separated portion of the print medium thus does not fall off, but, rather, may be removed and torn off by an operator. Behind the cutting edge 21, the movable blade comprises holes 23 that clean the fixed blade 13 as it is moved past. The movable blade 20 comprises deflectors 24 on the sides of the cutting edge 21 in order to guide said movable blade 20 along the fixed blade 13. The movement direction B, in which the movable blade 20 moves after installation into the cutting device, is indicated. The movable blade 20 comprises three connecting link guides 26, 27, 28 via which it may be moved by drive pins of two drive gears in the movement direction B. Each connecting link guide has a first segment 26 that extends parallel to the movement direction B. The first segment 26 begins at an edge 30 that is opposite the cutting edge 21. The movable blade 20 has at this edge an opening 25 into which the first segment 26 opens. Each connecting link guide has a second segment 27 that extends outwards, perpendicular to the movement direction B of the movable blade 20. If the drive pins are situated at the intersection point 28 between first segment 26 and second segment 27 of the connecting link guide, the movable blade may be removed via the first segment 26. The first segment has a first guide 31 that leads in a funnel shape into the first segment 26, and thus interacts with the drive pins in a self-guiding manner if the movable blade 20 is introduced into the cutting device. The first segment 26 has a second taper 32. An additional recess 29 of the movable blade 20 creates installation space for a manual drive of the movable blade 20.

Figure 5:
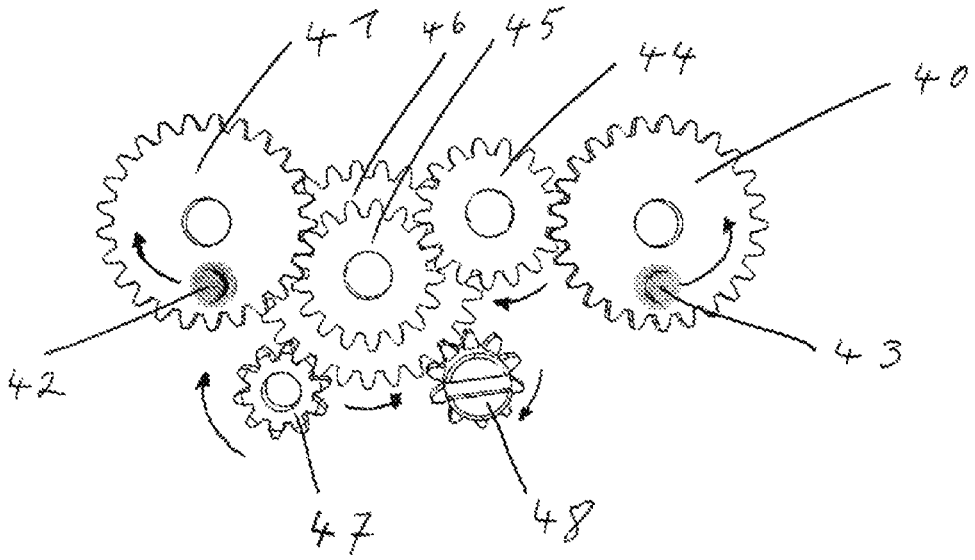
FIG. 5 a transmission for a cutting device according to the invention.

FIG. 5 shows a transmission for the cutting device. The transmission comprises two drive gears 40, 41, each carrying a drive pin 43, 42. Via a translation, the drive gears 40, 41 are respectively moved in the opposite direction by a motor with a motor gear 47. The drive pins 43, 42 thus execute a movement that is mirror-symmetrical. The movement of the motor gear 47 is transmitted to another gear 46 which is connected to a first translation gear 45. The first translation gear 45 drives a second translation gear 44. The first and second translation gears 45, 44 each engage in a drive gear 40, 41. The opposing movement of the drive gears 40, 41 is created via the first and the second translation gears 45, 44. Optionally, the transmission comprises a manual gear 48 with which the additional gear 46 may be manually moved if, for example, the function of the motor has failed. For this purpose, the manual gear 48 is driven with a turnscrew. The screw of the manual gear is guided by the further recess 29 through the movable blade 20. For simplification, in the following drawings, the manual gear is no longer shown.

Figure 6:
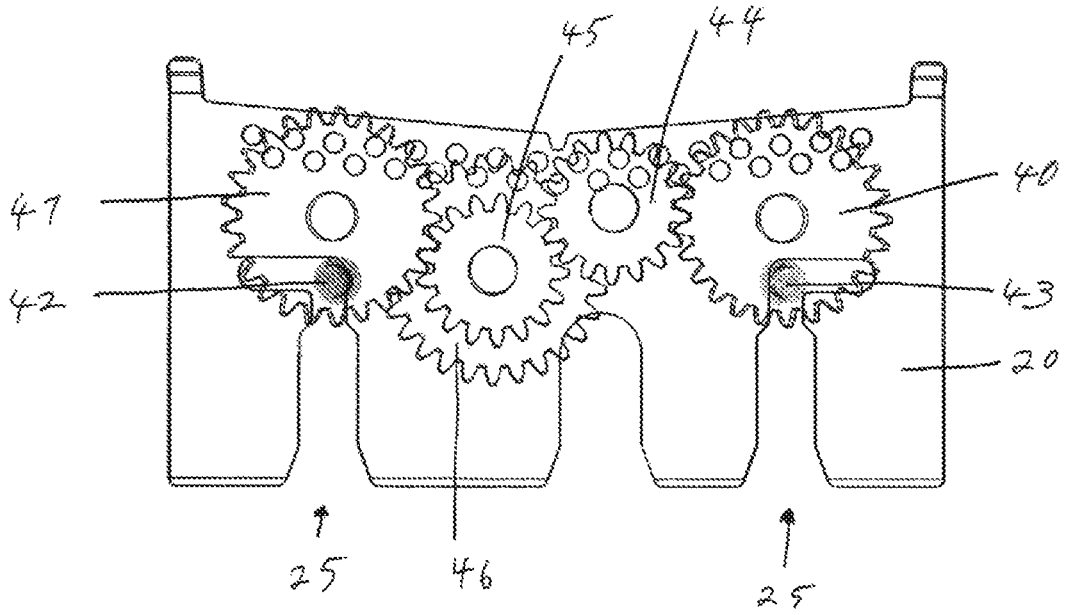
FIG. 6 the transmission and the movable blade, in a rest position.
Figure 7:
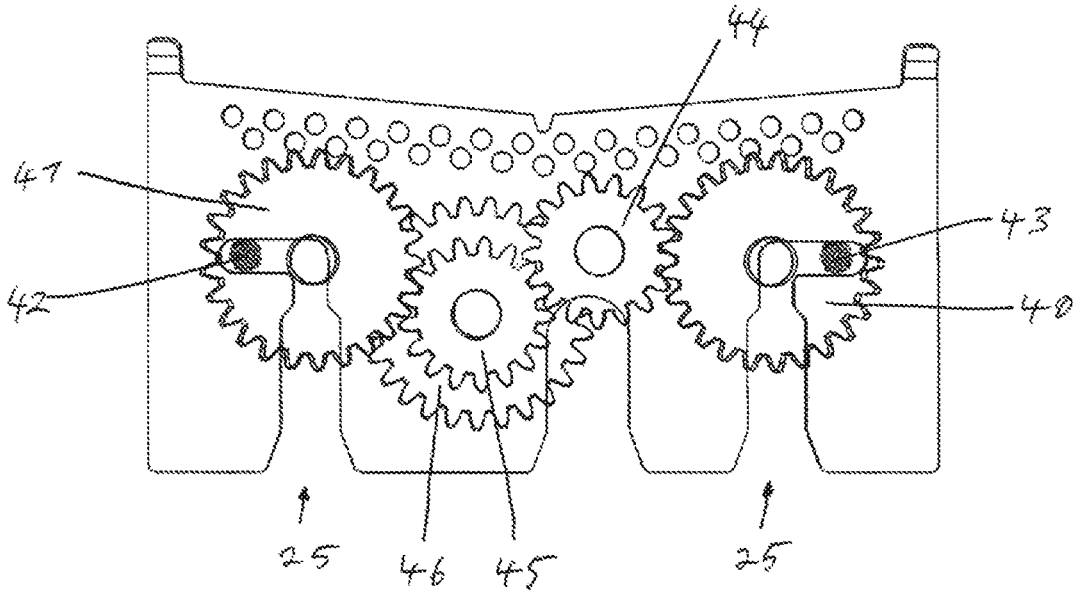
FIG. 7 the transmission and the movable blade in a position between a rest position and a cutting position, FIG. 8 the transmission and the movable blade, in a cutting position, FIG. 9 a cutting device according to the invention, in a lateral view, FIG. 10 a housing of a cutting device according to the invention, FIG. 11 a guide plate of a cutting device according to the invention.
Figure 8:
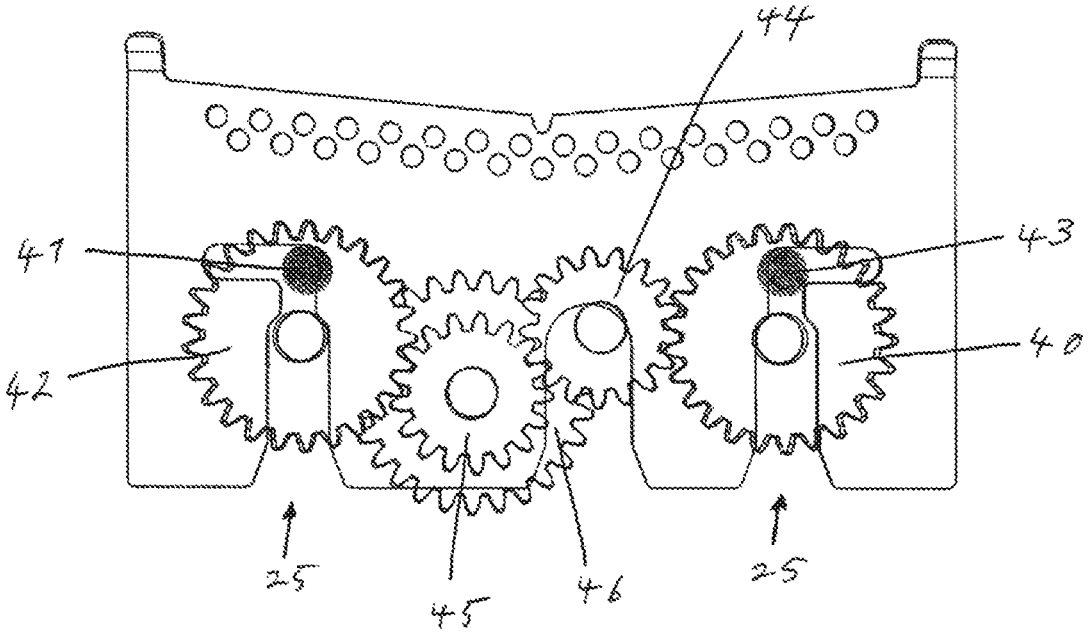

FIG. 6 shows the transmission and the movable blade 20 in a rest position. In this position, the moving blade 20 has disappeared in the housing of the cutting device. In this position, the drive pins 42, 43 are located at the intersection point 28 between the first segment 26 and the second segment 27 of the connecting link guides. FIG. 7 shows the transmission and the moving blade 20 in one position, when the moving blade 20 is extended or retracted along the movement direction B. In comparison to FIG. 6, the drive gears 40, 41 are rotated by a quarter-turn so that the drive pins 42, 43 are now on the outside of the drive gears 40, 41. The drive pins 42, 43 have moved along the second segment 27 of the connecting link guide, and the movable blade 20 has thus moved along the movement direction B. FIG. 8 shows the transmission and the moving blade in the cutting position or in the removal position. The drive gears 40, 41 are again rotated further by a quarter-turn. The drive pins 42, 43 are now at the top of the drive gears 40, 41. The drive pins 42, 43 are now located again at the intersection point 28 between the first segment 26 and the second segment 27 of the connecting link guides. In FIGS. 6-8, the gears of the transmission are mounted stationarily in the cutting device. It can be seen that, via a rotation of the transmission, the drive pins 42, 43 move along a circular path, and the moving blade 20 moves forward into the cutting position in comparison to the transmission. FIG. 8 shows the moving blade 20 in the cutting position. The cutting position is simultaneously also the removal position. However, to exchange the blade, the printer door 11 must be open, and the moving blade 20 must remain in the removal position, whereas, during operation, the printer door 11 is closed, and the moving blade 20 is only briefly moved into the cutting position and is immediately moved back again back into the rest position.

Figure 9:
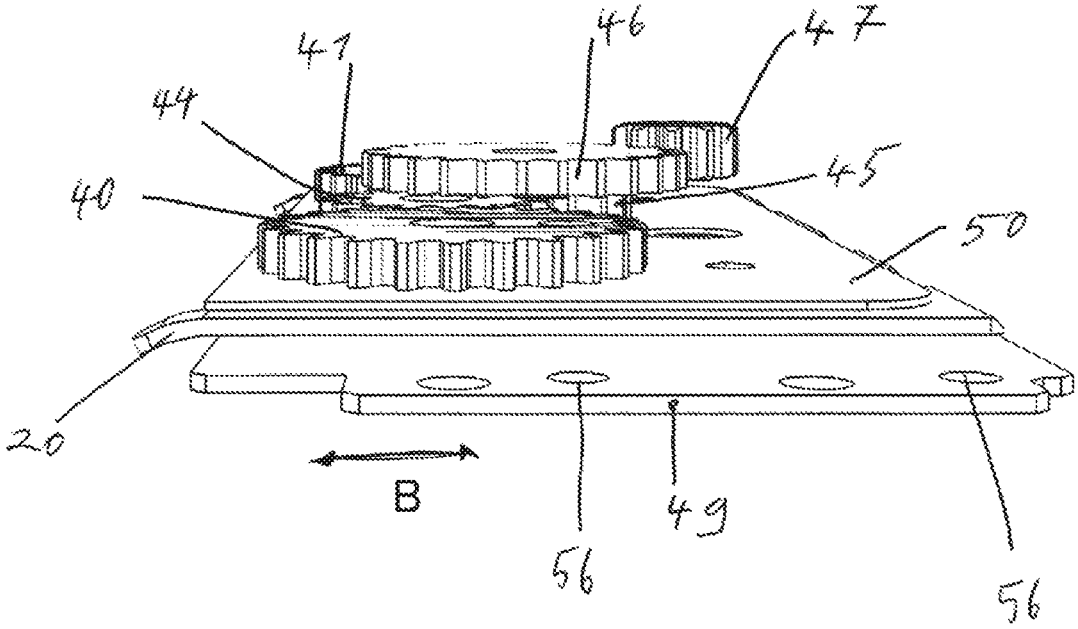

FIG. 9 shows the lateral view of the moving blade 20 in the cutting position. The moving blade 20 is held between a cover plate 49 of the cutting device and a guide plate 50. Thus, only a movement of the moving blade 20 in the movement direction B is possible. The transmission is mounted behind the guide plate 50, wherein the drive gears 40, 41 are mounted directly after the guide plate 50. The drive pins 42, 43 engage through the guide plate 50, as will be shown in the following. The transmission is retained in the housing of the cutting device, as is again shown in the following. The cover plate 49 comprises openings 56 for being screwed to the housing.

Figure 10:
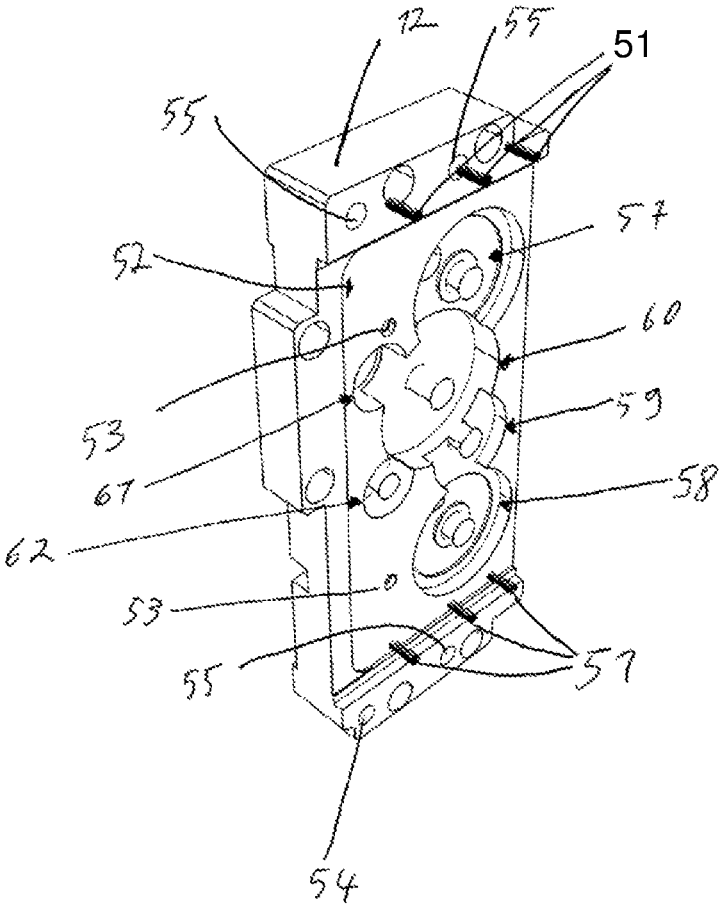

FIG. 10 shows the housing 12 of the cutting device. The housing 12 comprises guide pins 51 which predetermine the movement direction for the moving blade 20. In the housing 20 are receptacles 57, 58 for the drive gears 41, 40, a receptacle 59 for a translation gear 44, a receptacle 60 for the additional gear 46 and a translation gear 45, as well as a receptacle 61 for the motor gear 47. Moreover, a receptacle 62 for the manual gear 48 of the transmission is shown. The housing comprises a receptacle 52 for the guide plate 50, which is screwed into threads 53. The guide plate 50 serves as a cover for the transmission, in order to hold the gears stationary.

Figure 11:
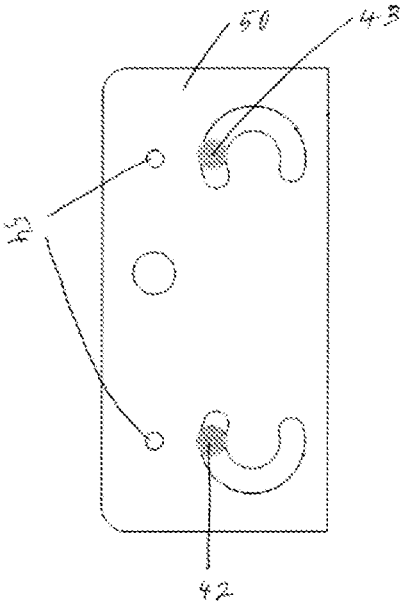

FIG. 11 shows the guide plate 50. The guide plate comprises holes 54 for screwing the guide plate into the housing 12 of the cutting device. The guide plate 50 comprises semicircular guides for the drive pins 42, 43. The guide plate 50 holds the gears of the transmission in the housing 12 of the cutting device and forms a guide for the moving blade 20.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A printer for printing on a print medium, comprising:

a receptacle configured to take up the print medium into a roll;

a print head configured to print onto the print medium during a printing process;

a print roller configured to direct the print medium past the print head during the printing process; and a cutting device configured to separate a printed portion of the print medium, the cutting device comprising a stationary blade, a blade that is movable against the stationary blade, and a drive motor configured to move the movable blade from a rest position, into a cutting position, and back, the drive motor comprising a transmission and at least one drive pin, wherein a rotational movement of the drive motor with the transmission and the at least one drive pin is converted into a linear movement of the moving blade, wherein a movement path of the at least one drive pin is circular or elliptical, wherein the movable blade comprises a connecting link guide into which the at least one drive pin engages, wherein the connecting link guide extends, in a first segment, from one edge of the movable blade, which edge is situated opposite a cutting edge of the movable blade, in a direction parallel to a movement direction of the movable blade, wherein the transmission is configured such that the at least one drive pin may be brought into a removal position by the rotational movement of the drive motor, and wherein, in the removal position, the at least one drive pin engages in the first segment of the connecting link guide.

2. The printer according to claim 1, wherein the connecting link guide has a second segment whose direction of extension differs from the movement direction of the movable blade, and whose extension direction is perpendicular to the movement direction of the movable blade.

3. The printer according to claim 1, wherein the transmission is configured to drive a second drive pin, and wherein the second drive pin engages in a second connecting link guide.

4. The printer according to claim 3, wherein the movement paths of the two drive pins run mirror-symmetrically along an axis which is parallel to the movement direction of the movable blade, and wherein the two connecting link guides are arranged mirror-symmetrically relative to the axis in the movable blade.

5. The printer according to claim 1, wherein the printer comprises a printer housing and a printer door, wherein the printer door is configured to execute a rotational movement for opening the printer door, and wherein the movable blade is arranged in the printer housing and the fixed blade is arranged in the printer door, or the movable blade is arranged in the printer door and the fixed blade is arranged in the printer housing.

6. The printer according to claim 1, wherein the movable blade comprises one piece and is configured to slide in a guide of the cutting device, and wherein a movement direction of the movable blade is limited by the guide to one direction.

7. The printer according to claim 1, wherein a cutting edge of the movable blade is formed in a V-shape and has a recess at an inflection point of the V-shape.

8. The printer according to claim 7, wherein the printer comprises a sensor configured to monitor the printer door, and the movement of the at least one drive pin into the removal position by the drive motor is possible only if the printer door is open.

9. The printer according to claim 1, wherein the movable blade is directed between a cover plate and a guide plate, wherein the guide plate and the cover plate determine a lateral position of the movable blade in the printer, and wherein the movement direction of the movable blade is defined by a lateral guide.

10. The printer according to claim 1, wherein the transmission comprises two identical drive gears that each retain a drive pin and are arranged symmetrically relative to a movement direction of the movable blade, wherein the transmission comprises two identical translation gears which mutually engage in one another, wherein each translation gear engages in a drive gear, and wherein the drive motor is configured to drive a translation gear vis-à-vis a motor gear.

11. A method for exchanging a movable blade of a cutting device of a printer for printing on a print medium, the printer comprising:

a receptacle configured to take up the print medium into a roll;

a print head configured to print onto the print medium during a printing process;

a print roller configured to direct the print medium past the print head during the printing process; and the cutting device configured to separate a printed portion of the print medium, the cutting device comprising a stationary blade, the movable blade that is movable against the stationary blade, and a drive motor configured to move the movable blade from a rest position, into a cutting position, and back, the drive motor comprising a transmission and at least one drive pin, wherein a rotational movement of the drive motor with the transmission and the at least one drive pin is converted into a linear movement of the moving blade, wherein a movement path of the at least one drive pin is circular or elliptical, wherein the movable blade comprises a connecting link guide into which the at least one drive pin engages, wherein the connecting link guide extends, in a first segment, from one edge of the movable blade, which edge is situated opposite a cutting edge of the movable blade, in a direction parallel to a movement direction of the movable blade, wherein the transmission is configured such that the at least one drive pin may be brought into a removal position by the rotational movement of the drive motor, and wherein, in the removal position, the at least one drive pin engages in the first segment of the connecting link guide wherein the method comprises the following steps:

receiving a blade exchange instruction at an input device, and transitioning the printer into a service mode;

rotating the drive motor of the cutting device into a position in which the at least one drive pin is in the removal position;

receiving an instruction that the cutting device is to transition into a printing mode;

rotating the drive motor into a position in which the at least one drive pin is in the rest position; and transitioning the printer into the printing mode.

12. The method according to claim 11, wherein, prior to the rotation of the drive motor into a position in which the the at least one drive pin is in the removal position, the method includes a step of checking, using a sensor, whether a printer door of the printer is open.

13. The method according to claim 11, wherein, before transitioning the printer into the printing mode, the method includes a step of checking, using a sensor, whether a printer door of the printer is closed.

* * * * *